US006108881A

United States Patent [19]

Huang

[11] Patent Number: 6,108,881

[45] Date of Patent: Aug. 29, 2000

[54] TERMINAL PRESSING MACHINE

[76] Inventor: Chin-Ting Huang, No. 308m Ta-Feng Second Rd., San-Min Dist., Kaohsiung City, Taiwan

[21] Appl. No.: 09/116,475

[22] Filed: Jul. 16, 1998

[51] Int. Cl.[7] ..... H01R 43/24

[52] U.S. Cl. ..... 29/33 M; 29/33 F; 29/566.2; 29/747; 29/874

[58] Field of Search ..... 29/33 M, 33 K, 29/33 F, 747, 566.1, 566.2, 566.3, 564.6, 564.8, 874, 883

[56] References Cited

U.S. PATENT DOCUMENTS

| | | | |
|---|---|---|---|
| 4,807,357 | 2/1989 | Zahn | 29/747 X |
| 4,927,370 | 5/1990 | Murphy | 29/874 |
| 5,535,497 | 7/1996 | Huang | 29/33 F |
| 5,575,058 | 11/1996 | Nakamura et al. | 29/33 M X |
| 5,778,527 | 7/1998 | Barenboim et al. | 29/566.2 X |

*Primary Examiner*—William Briggs
*Attorney, Agent, or Firm*—Browdy and Neimark

[57] ABSTRACT

An SMD-C type terminal automatically pressing machine comprising a support frame, a wire reel rack, a wire clipping mold, an embossing mold, a shearing mold, a material feeding device, a first wire shifting clamp, a second wire shifting clamp and a rectifying mold. The wire clipping mold, embossing mold and shearing mold sequentially process a wire track pulled out from the wire reel mounted on the wire reel rack and performing the pin insertion operation. Thereafter, the first wire shifting clamp first completes the wire shifting operation with respect to the lower half portion of the inserted terminal. Then the material feeding device sends the terminal, in which the lower half portion has been completely shifted, to the second working area. Then the second wire shifting clamp performs the wire shifting operation with respect to the upper half portion of the terminal. After the wire shifting operation is completed, the rectifying mold processes the straight wire track on two sides of the terminal into a symmetrical C-shaped pattern.

1 Claim, 12 Drawing Sheets

TERMINAL PRESSING MACHINE

BACKGROUND OF THE INVENTION

The present invention relates to an SMD-C type terminal automatically pressing machine which continuously automatically performs pin insertion operation for C-shaped terminal. The wire clipping mold, embossing mold and shearing mold sequentially process a straight wire track and complete the pin insertion operation on two sides of the terminal. Thereafter, the first wire shifting clamp, second wire shifting clamp and the rectifying mold at one time process the straight wire track on two sides of the terminal into a symmetrical C-shaped pattern. Therefore, the manually bending operation of the pin of the terminal is no more necessary.

The pin insertion operation of various types of terminals has been automatized. However, in the pin insertion operation, the conventional terminal automatically pressing machine can only process straight wire track 4 (as shown in FIG. 4A) inserted in the connecting seat 301 of the terminal 3. Or, an L-shaped wire track on one side of the connecting seat 301 of the terminal 3 is first formed and the wire track on the other side of the connecting seat 301 is secondarily repeatedly processed into L-pattern. Therefore, it is necessary to twice process the wire track to form two symmetrical L-shaped pattern (as shown in FIG. 4B). Accordingly, the conventional terminal automatically pressing machine cannot complete the pin insertion operation with respect to C-shaped terminal 3 as shown in FIG. 4C and it is necessary for an operator to further bend the wire track with a tool so as to complete the pin insertion operation of C-shaped terminal as shown in FIG. 4C.

SUMMARY OF THE INVENTION

It is therefore a primary object of the present invention to provide an SMD-C type terminal automatically pressing machine which continuously automatically completes the pin insertion operation for C-shaped terminal at one time.

It is a further object of the present invention to provide the above terminal automatically pressing machine which the pin insertion operation of C-shaped terminal is totally automatized without using any labor so as to save time and strength and increase production efficiency and lower manufacturing cost.

The present invention can be best understood through the following description and accompanying drawings, wherein:

DETAILED DESCRIPTION OF THE PREFERRED EMBODIMENT

Figure 1:
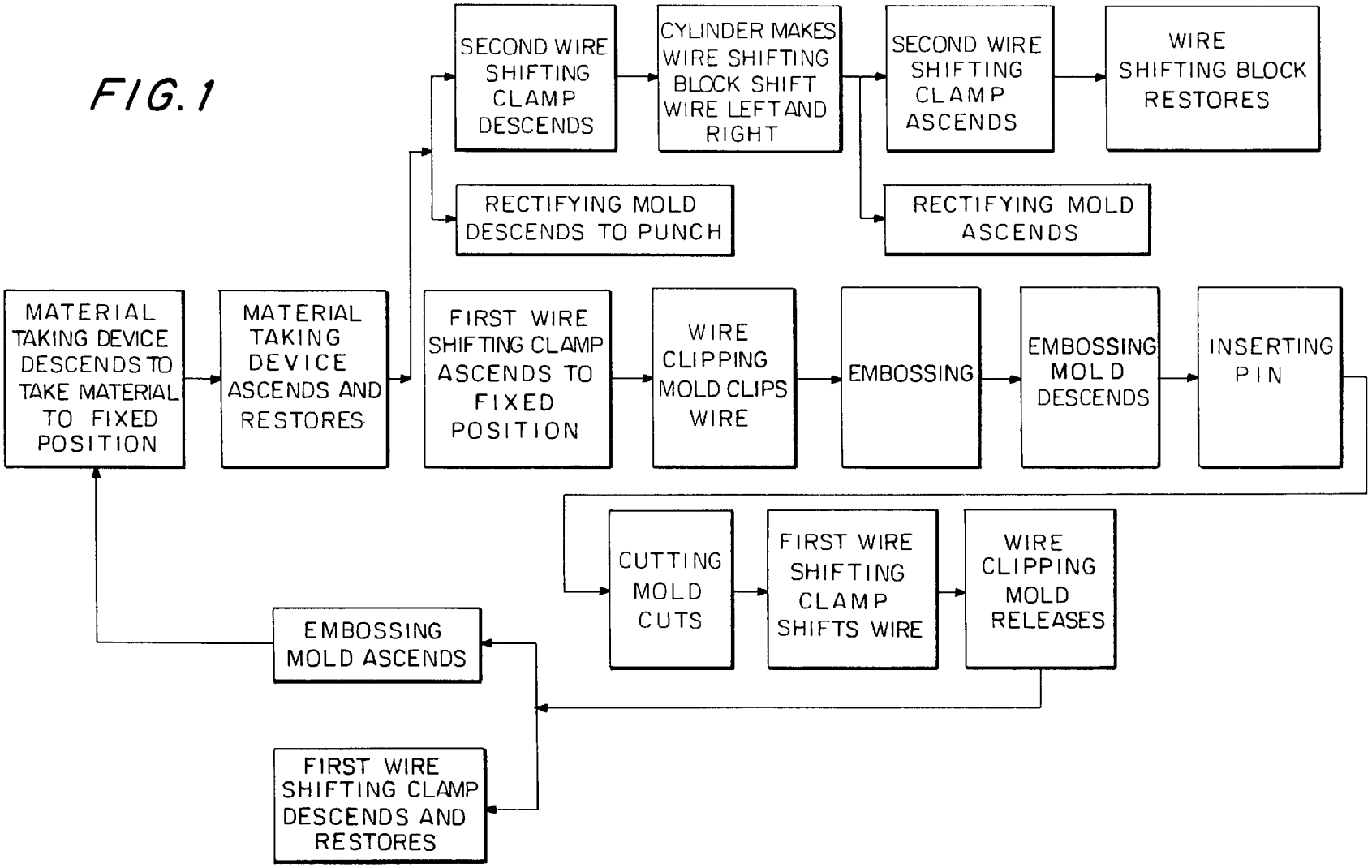
FIG. 1 is a flow chart of the processing operation of the present invention.
Figure 2:
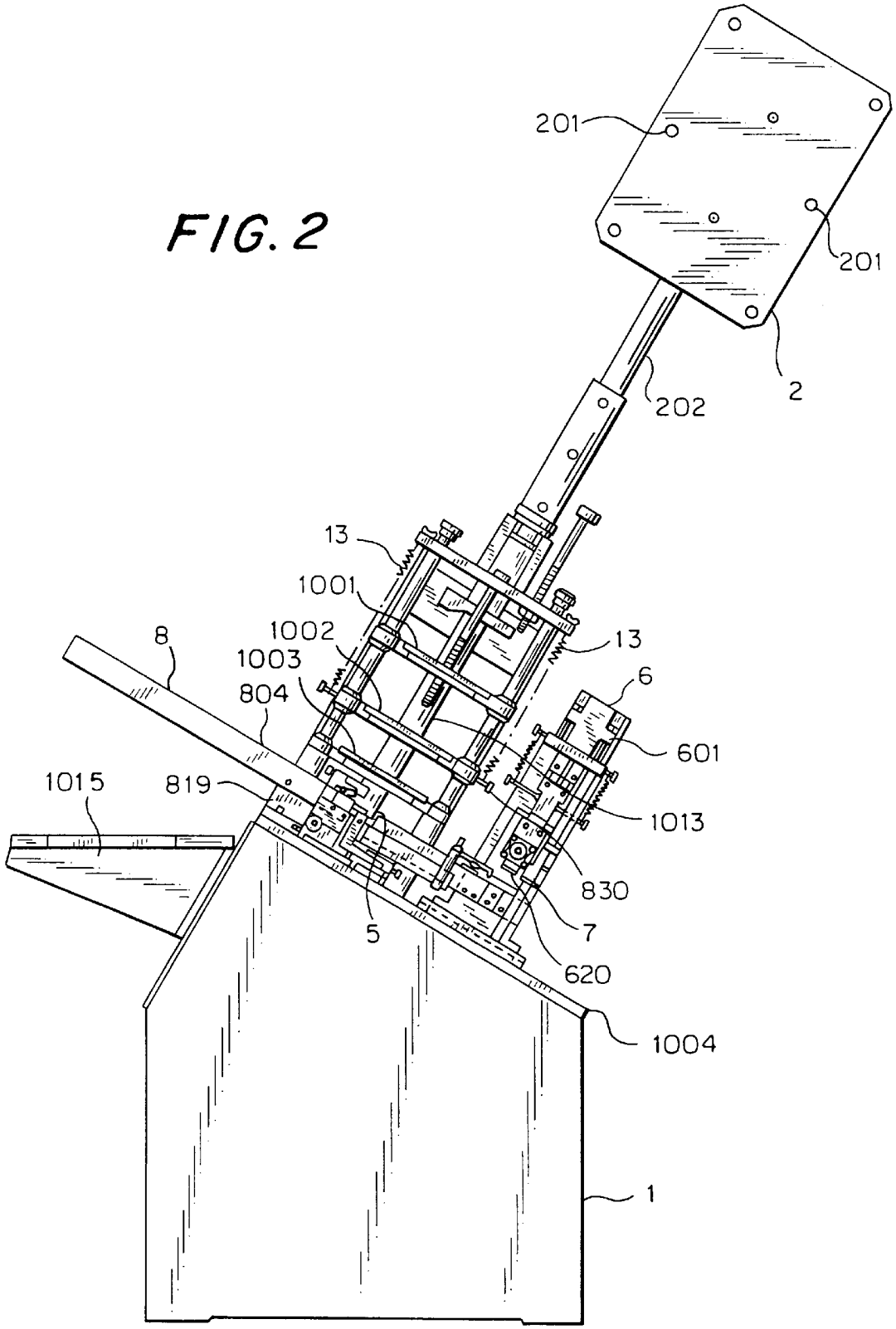
FIG. 2 is a side assembled view of the structure and support frame of the present invention.

Please refer to FIG. 2. The present invention includes a support frame 1, a wire reel rack 2, a wire clipping mold (not shown), an embossing mold (not shown), a shearing mold (not shown), a material feeding device 8, a first wire shifting clamp 5, a second wire shifting clamp 6 and a rectifying mold 7. The wire clipping mold is mounted on a first fixing seat 1001. The embossing mold is mounted on a second fixing seat 1002. The shearing mold is mounted in a third fixing seat 1003. The wire reel rack 2 is located above the first fixing seat 1001 and connected with the support frame 1.

Figure 3:
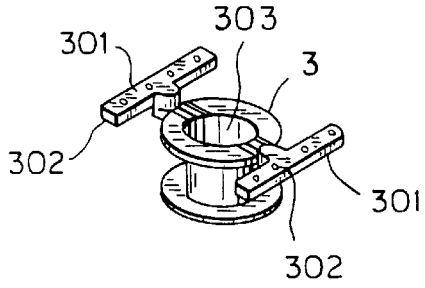
FIG. 3 is a perspective view of the terminal of the present invention prior to processing.
Figure 4A:
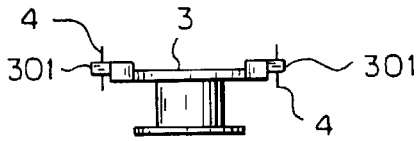
FIG. 4A shows a first stage of processing operation of the terminal of the present invention.
Figure 4B:
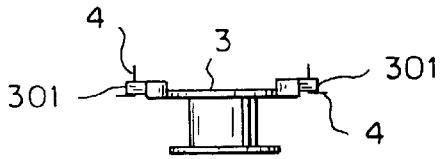
FIG. 4B shows a second stage of processing operation of the terminal of the present invention.
Figure 4C:
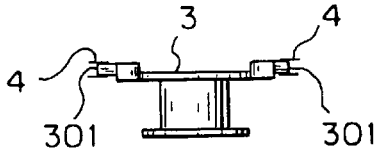
FIG. 4C shows the completely processed terminal of the present invention.
Figure 5:
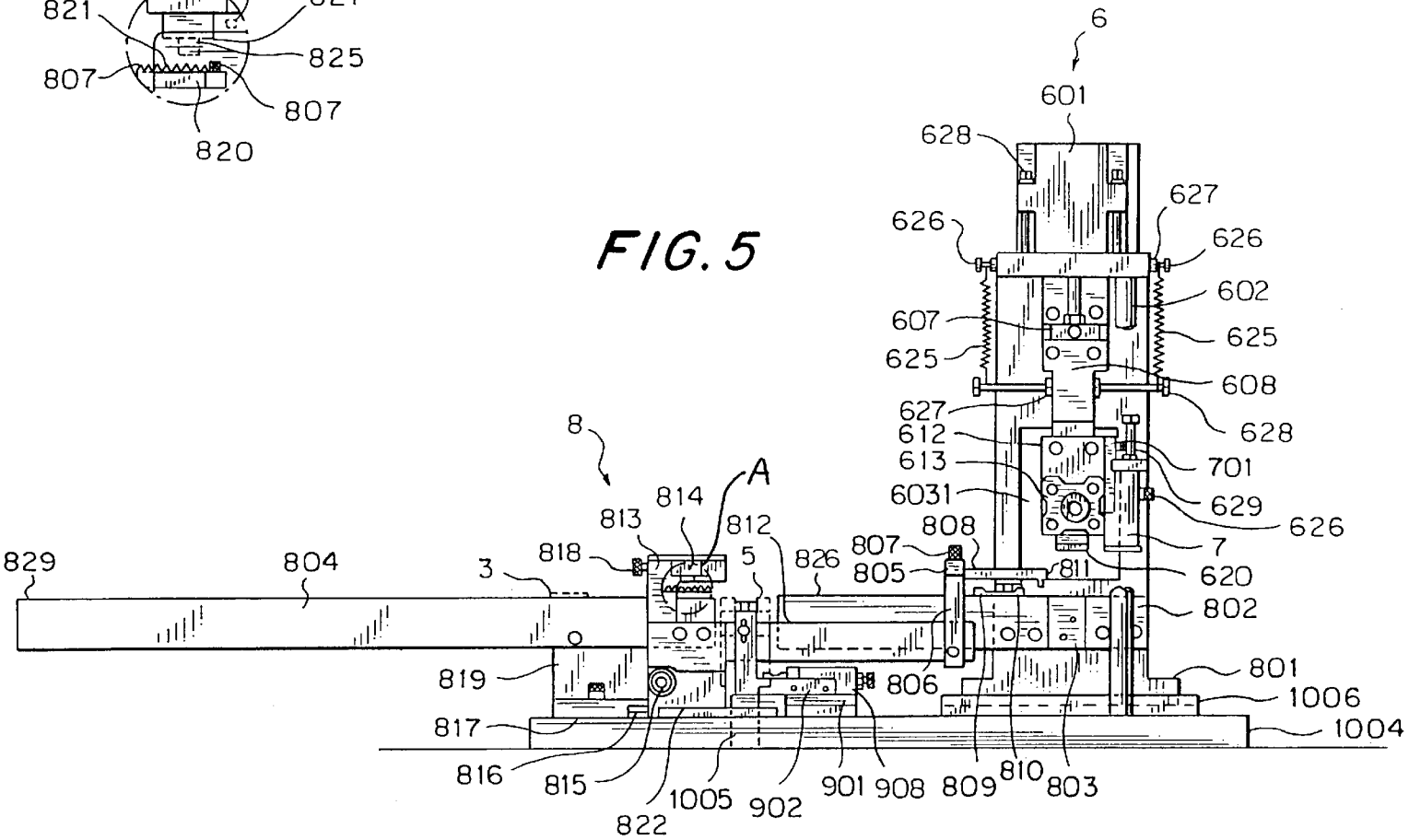
FIG. 5 is a side assembled view of the material feeding device and the first and second wire shifting clamps of the present invention.
Figure 5A:
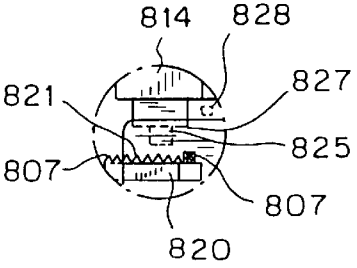
FIG. 5A is an enlarged view of circled area A in FIG. 5.
Figure 6:
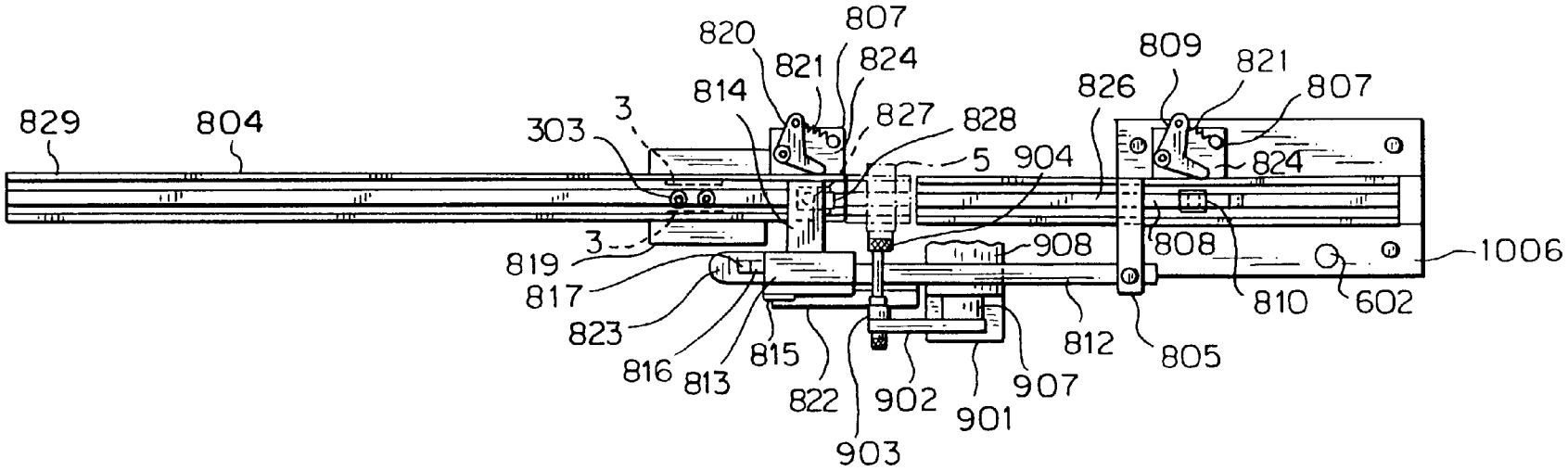
FIG. 6 is an upper assembled view of the material feeding device of the present invention.
Figure 7:
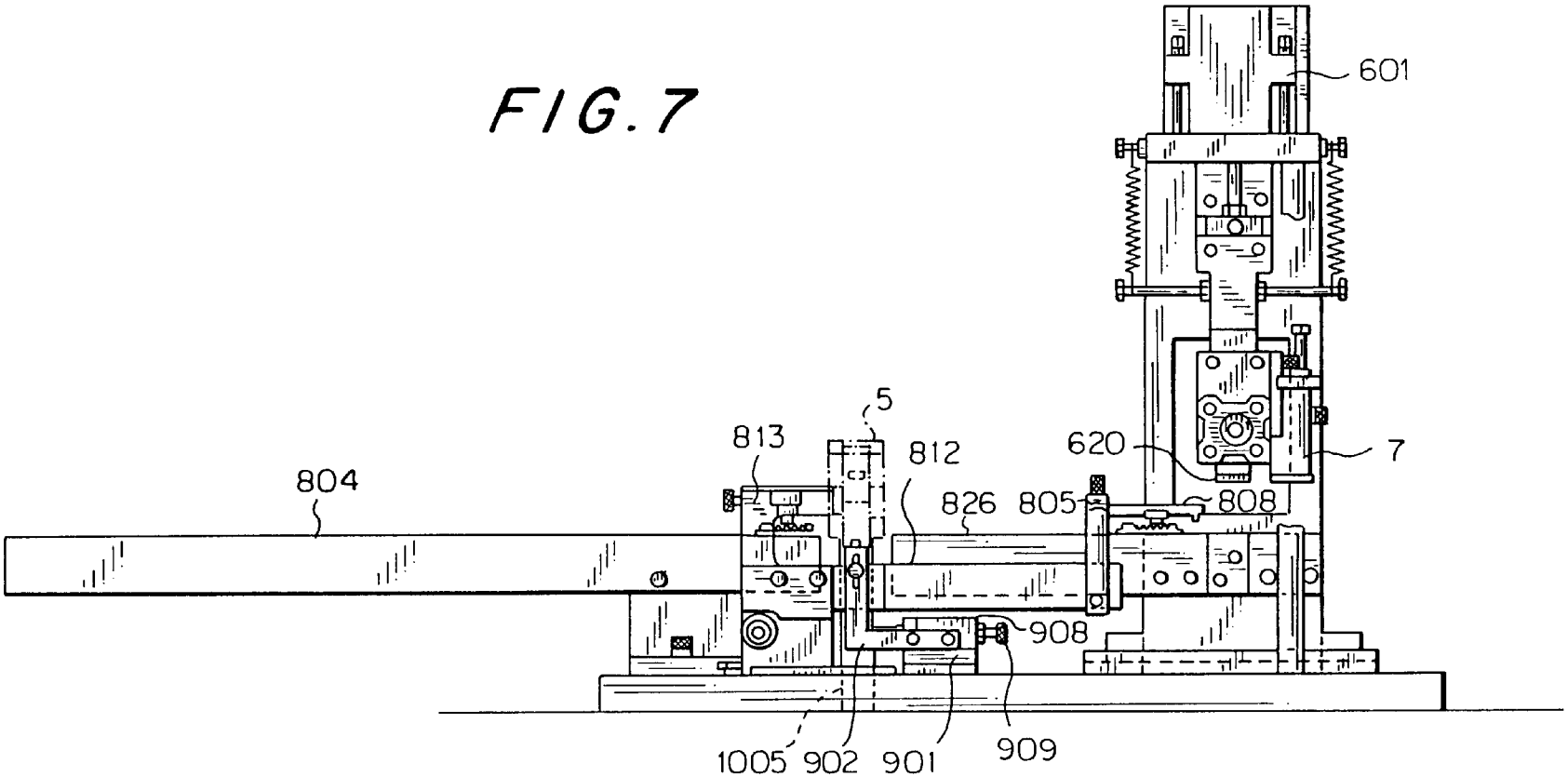
FIG. 7 shows that the first wire shifting clamp of the present invention moves upward.
Figure 8:
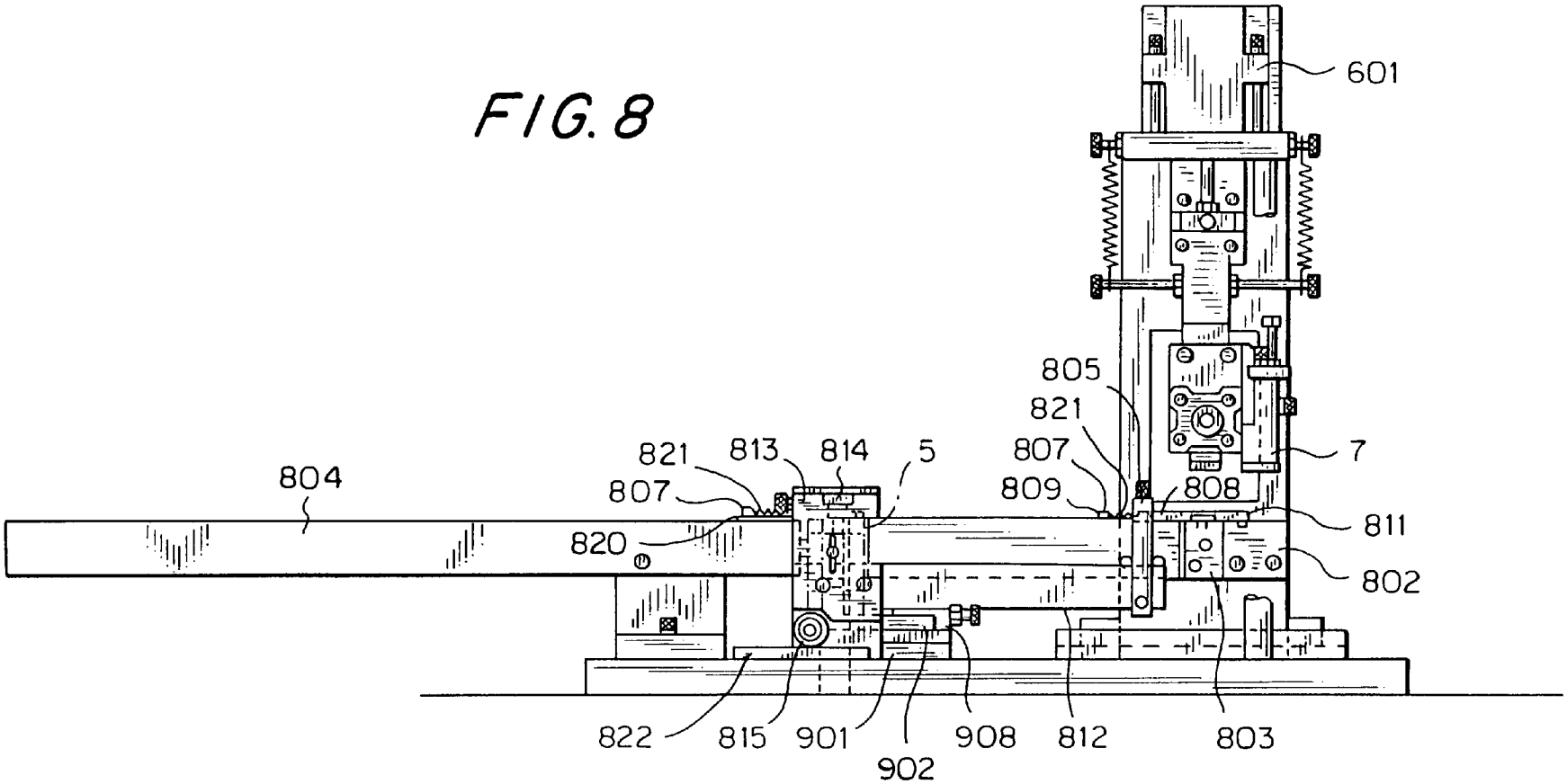
FIG. 8 shows the operation of the material feeding device of the present invention.
Figure 9A:
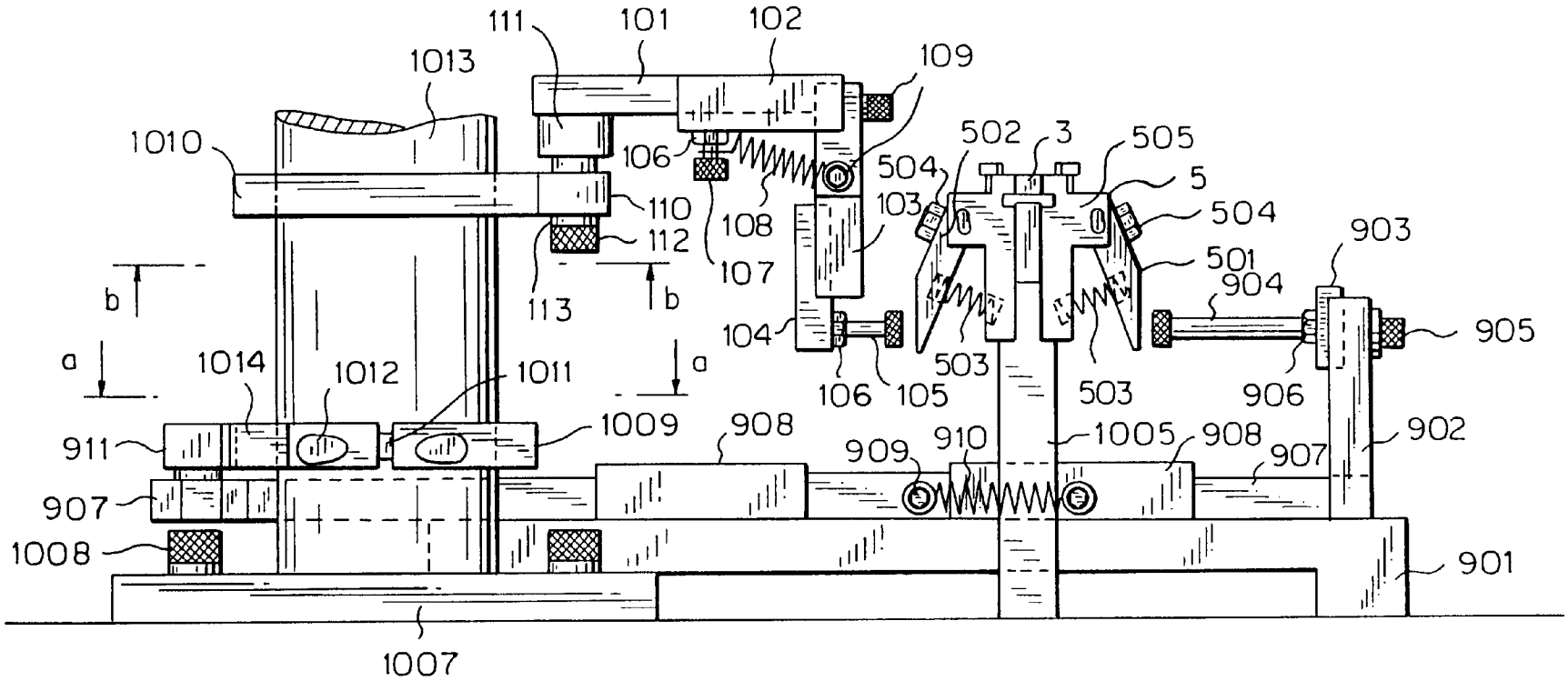
FIG. 9A shows the operation of the first wire shifting clamp of the present invention in one state.
Figure 9B:
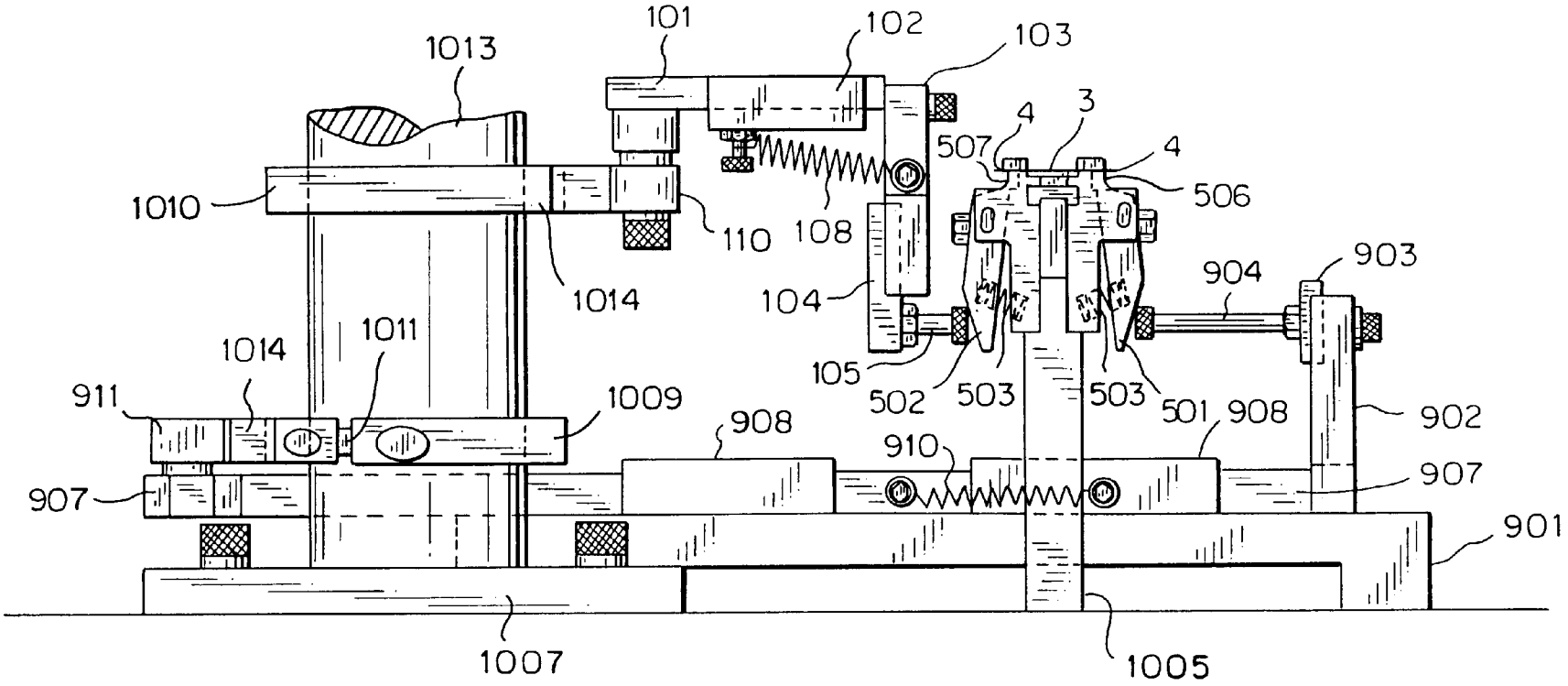
FIG. 9B shows the operation of the first wire shifting clamp of the present invention in another state.
Figure 10A:
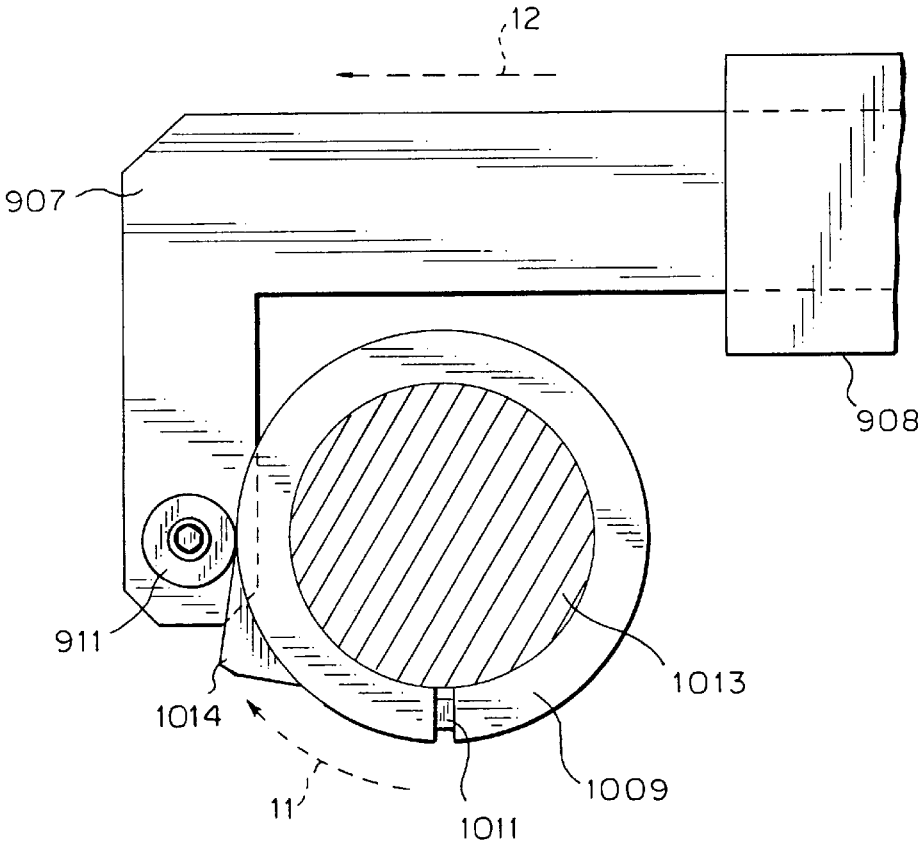
FIG. 10A is a sectional view taken along line a—a of FIG. 9A.
Figure 10B:
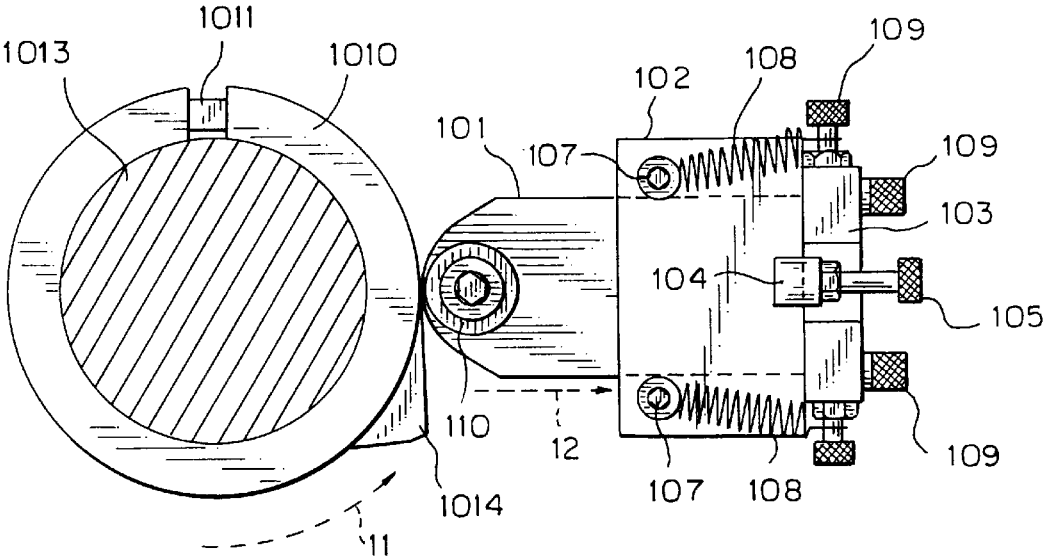
FIG. 10B is a sectional view taken along line b—b of FIG. 9A.
Figure 11A:
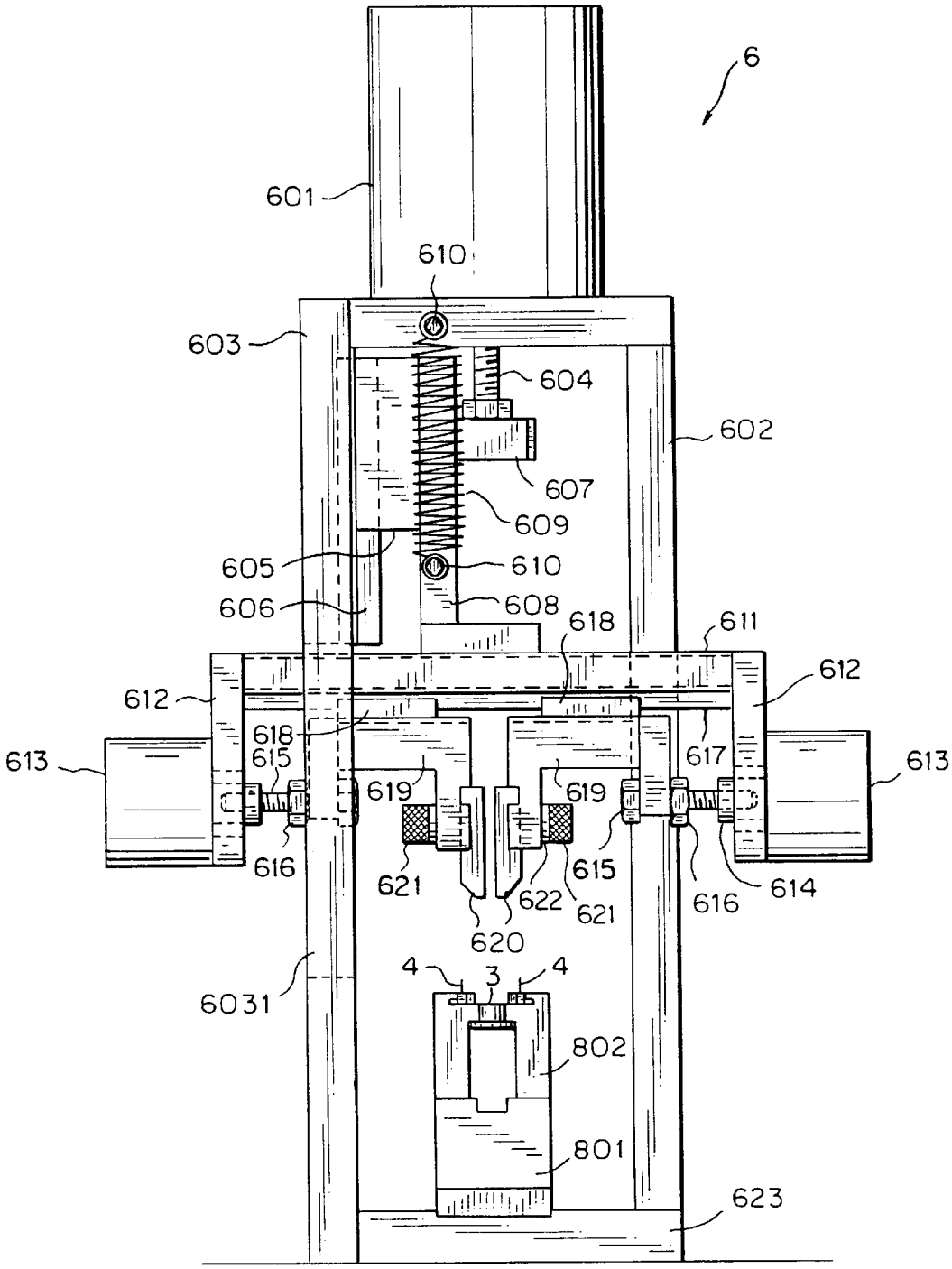
FIG. 11A shows the operation of the second wire shifting clamp of the present invention in one state.
Figure 11B:
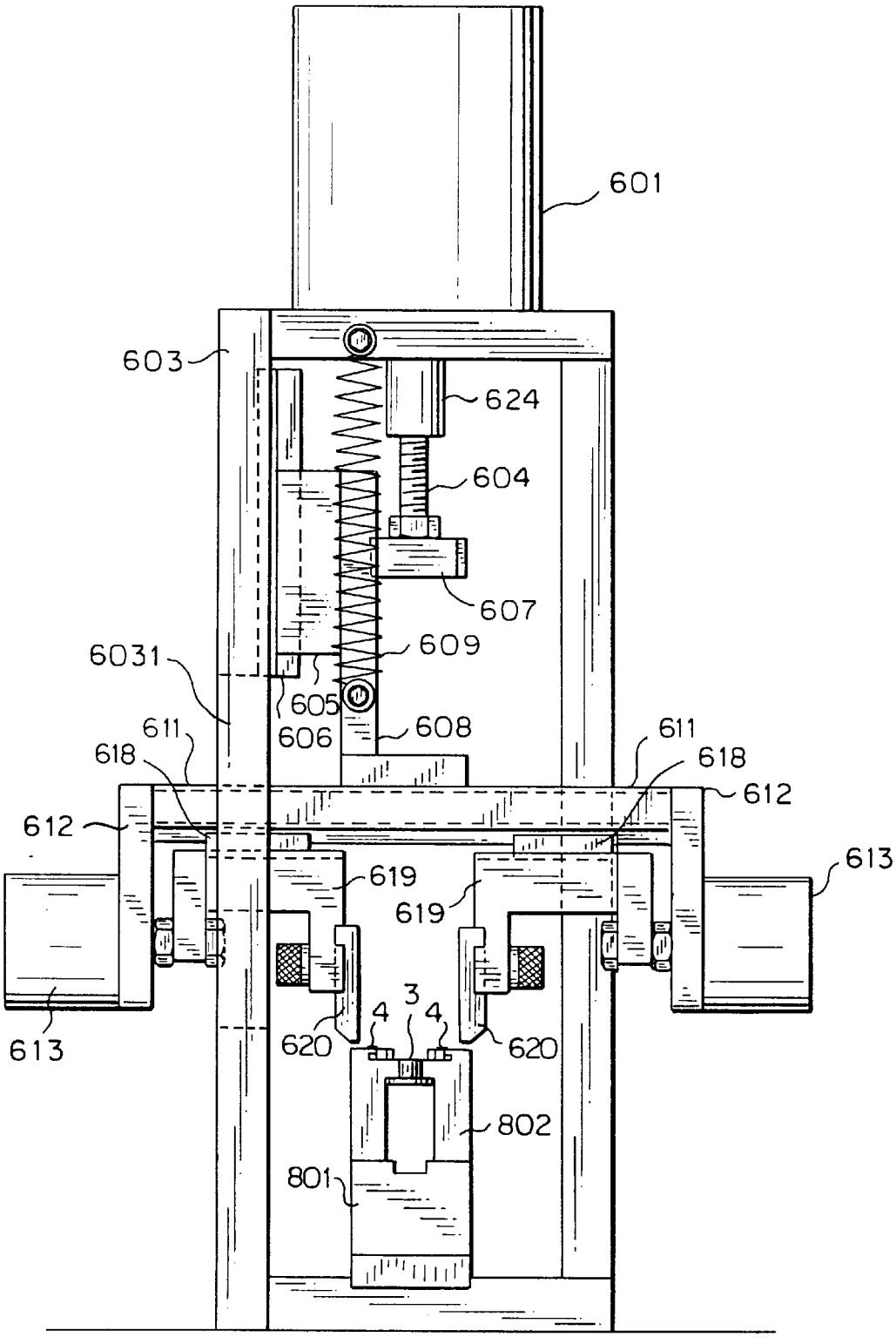
FIG. 11B shows the operation of the second wire shifting clamp of the present invention in another state.

Please refer to FIGS. 2 and 6. Prior to the operation, the terminals 3 as shown in FIG. 3 are sequentially placed into an inclined material feeding rail 804. At this time, due to the inclination of the material feeding rail 804, the terminals will automatically slide downward until the terminals 3 are restricted frog downward sliding by a restricting hook block 820 beside the material feeding rail 804 and located beside the restricting hook block 820. After operation (referring to FIG. 5 and FIG. 5A), a vertically movable fixing seat 813 of the material feeding device 8 is driven by a transmission mechanism to ascend until a roller 815 of the fixing seat 813 contacts with a plastic guide pad 822. At this time, two portions of the material feeding device 8 will synchronously operate. One of the portions is a moving arm 814 fixedly inserted with the fixing seat 813, which also moves downward to urge a material taking block 827 on the moving arm 814 to move downward. At this time, a projecting post 825 of the material taking block 827 is inserted into a circular hole 303 of the terminal 3, whereby the material gripping block 827 can take the terminal 3. The other of the portions is a moving arm 812 connected on the fixing seat 813, which will urge a moving arm fixing seat 806 screwed on the moving arm 812 to move downward. At this time, a moving arm 805 screwed on the fixing seat 806 will urge a material feeding lever 808 to move downward. Also, a material taking block 810 on the material feeding lever 808 will move downward. However, because the operation has just started, there is no terminal below the material taking block 810. Only after several times of operation of the material feeding device 8, the terminals 3 will be sequentially fed from the material feeding rail 826 to the lower side of the material taking block 810. In order to better understand the synchronous operation of the present invention, it is assumed that the terminals 3, which have already gone through the first material shifting process as shown in FIG. 4B by the first wire shifting clamp 5, are arranged on the material feeding rail 826. The terminals are sequentially sent by the moving arm 814 to the material feeding rail 826 and arranged thereon. Accordingly, at this time, the terminals 3 taken by the material taking block 827 are the terminals 3 as shown in FIG. 3 and the terminals 3 taken by the material taking block 810 are the terminals 3 as shown in FIG. 4B. After both the material taking blocks 827, 810 take the terminals, the transmission mechanism makes the vertically movable fixing seat 813 via the rollers 815 start to move forward on the plastic guide pad 822 (as shown in FIG. 8). At this time, the material taking block 827 will shift the terminal 3 as shown in FIG. 3 to the first wire shifting clamp 5 and fix the terminal 3 via a lateral leaf spring (not shown) thereof. When shifting the terminal 3 as shown in FIG. 3, another terminal 3 behind the terminal 3 is restricted and located by the restrciting hook block 820. Therefore, only one terminal will be moved forward in one shift. The other material taking block 810 is also moved forward by the moving arm 812 of the fixing seat 813 so as to make the fixing seat 806 drive the moving arm 805 which further makes the material feeding lever 808 drive the material taking block 810. The material taking block 810 shifts the terminals 3 as shown in FIG. 4B onto the material shifting fixing block 803 and locates the terminals via a lateral leaf spring (not shown). After both the material taking blocks 827, 810 are moved to a fixed position, the transmission mechanism makes the vertically movable fixing seat 813 move upward and back to its home position. At this time, the material taking blocks 827, 810 are also restored to their home positions. Thereafter, two portions simultaneously operate. One of the portions is the transmission mechanism which makes a lifting shaft 1005 move upward. At the same time, the first wire shifting clamp 5 mounted on the lifting shaft 1005 moves upward as shown in FIG. 7 and the terminal located thereon as shown in FIG. 3 synchronously moves upward. At this time, after sequentially processed by the wire clipping mold, the embossing mold and the shearing mold, the terminal located on the first wire clamp 5 as shown in FIG. 3 will he formed into the pattern of the terminal 3 as shown in FIG. 4A (also referring to FIGS. 9A and 10A). At the same time, the transmission shaft 1013 has already started to rotate, making a projecting block 1014 of a cam 1009 screwed on the transmission shaft 1013 contact with a roller 911 screwed on an L-shaped slide block 907 (as shown in FIG. 10A). Therefore, after the terminal 3 as shown in FIG. 4A is completely formed, the first wire shifting clamp 5 starts the wire shifting operation. At this time, due to the rotation of the transmission shaft 1013, the thread rods 904, 105 will both move forward. Referrig to FIG. 10A, because the transmission shaft 1013 drives the cam 1009 to rotate, the thread rod 904 makes the roller 911 of the L-shaped slide block 907 roll along the projecting block 1014 so as to make the L-shaped slide block 907 move leftward in a direction 12. At this time, an L-shaped block 902 is driven to make the thread rod 904 press the wire shifting arm 501 as shown in FIG. 9B and make the recess 506 pry the wire track 4 into a substantially 90 degree state. After the roller 911 rolls over the projecting block 1014, the L-shaped slide block 907 is assisted by two lateral springs 910 to move rightward. Also, the thread rod 904 is moved rightward. At this time, the wire shifting arm 501 will be restored to its home position due to the operation of the spring 503. Referring to FIGS. 9A and 10B, because the transmission shaft 1013 also directly drives the cam 1010 to rotate, the other thread rod 105 makes the roller 110 screwed on the slide block 101 roll along the projecting block 1014 so as to make the slide block 101 move rightward in a direction 12 to drive the pushing rod fixing seat 103 and further drive the locating block 104 to make the thread rod 105 press the wire shifting arm 502 as shown in FIG. 9B. Therefore, the recess 507 pries the wire track 4 into a substantially 90 degree state. Similarly, after the roller 110 rolls over the projecting block 1014, the slide block 101 again moves leftward, making the thread rod 105 move leftward. At this time, the wire shifting arm 502 is restored to its home position by the spring 503. Therefore, when the transmission shaft 1013 rotates, the cams 1009, 1010 thereof are also rotated so as to make the thread rods 904, 105 simultaneously operate and make the wire shifting arms 501, 502 simultaneously shift the wire to complete the pattern of the wire track 4 of the terminal 3 as shown in FIG. 4B. When the first wire shifting clamp 5 starts to move upward prior to shift the wire, the other portion also operates at the same time when the first wire shifting clamp 5 moves upward (referring to FIGS. 5 and 11A). At this time, the terminal 3 positioned on the material shifting fixing block 803 is the terminal which has gone through the first processing as shown in FIG. 4B. Therefore, when the first wire shifting clamp 5 moves upward, the second wire shifting clamp 6 also starts to operate. Referring to FIGS. 11A and 11B, the cylinder 601 first starts to operate, making the thread rod 604 screwed on the piston stem 624 press the locating block 607. The locating block 607 drives the L-shaped block 608 and slide block 605, making the slide block 605 move downward along the slide rail 606 and making a movable retaining board 611 drive two wire shifting blocks 620 to move downward into two wire tracks 4. Then two cylinders 613 start to operate, making the piston stem 614 drive a screw 615 screwed on the wire shifting block fixing seat 619 and making the slide block 618 screwed on the fixing seat 619 move to two sides along the slide rail 617. Further, the two wire shifting block fixing seats 619 directly drive two wire shifting blocks 620 to shift the wire toward two sides as shown in FIG. 11B. Accordingly, the wire track 4 of the terminal as shown in FIG. 4B can be processed to form the pattern of the wire track 4 of the terminal 3 as shown in FIG. 4C. Thereafter, the cylinder 601 immediately operates and retracts to make the L-shaped block 608 via the springs 609 on two sides drive the movable retaining board 611 to move upward. After the wire shifting structure as shown in FIG. 11B first moves upward to a fixed position, two cylinders 613 operate, making two wire shifting blocks 620 restore to their home position. However, the rectifying mold 7 (referring to FIG. 5 and FIG. 5A) is screwed on the rectifying mold fixing seat 701 and the rectifying mold fixing seat 701 is screwed on the movable retaining board 611, so that when the retaining board 611 in the second wire shifting clamp 6 moves downward, the rectifying mold 7 also moves downward to process and rectify the terminal 3 as shown in FIG. 4C, whereby the wire trick 4 of the terminal 3 is bent into a C-shaped pattern. Therefore, referring to FIG. 5, after the first wire shifting clamp 5 completes the first stage of wire processing, at the same time when the first wire shifting clamp 5 moves downward (the second wire shifting clamp 6 and the rectifying mold 7 have completed the processing operation and restored to home position), the embossing mold will simultaneously move upward. After the first wire shifting clamp 5 moves downward from the position of FIG. 7 back to its home position as shown in FIG. 5 and FIG. 5A, the material taking blocks 827, 810 in the material feeding device 8 will repeat the above operation to further take the terminal 3 of FIG. 3 onto the first wire shifting clamp 5. The material feeding lever 828 of FIG. 6 will upward push the terminal 3 of FIG. 4B from the first wire shifting clamp 5 into the material feeding rail 826. The terminal 3 fed into the material feeding rail 826 will push the forward terminal 3 as shown in FIG. 4B and make the terminal 3 sequentially push a forward terminal to make the leading terminal 3 move to lower side of the material taking block 810. The material taking block 810 will synchronously takes the terminal 3 of FIG. 4B thereunder onto the material shifting fixing block 803. The front end 811 of the material feeding lever 808 will make the forward C-shaped terminal 3 of FIG. 4C on the material shifting fixing block 803 into the rectifying fixing block 802. The C-shaped terminal 3 is forward pushed by the terminal pushed by the front end 811 of the material feeding lever 808 to slide into the product collection area along a material guiding channel (not shown). Therefore, at this time, the terminals positioned on the first wire shifting clamp 5, material shifting fixing block 803 and the rectifying fixing block 802 are all to be processed and the above wire shifting and rectifying operations are repeated and the material feeding device 8 again sequentially repeatedly processes the terminals.

Accordingly, referring to FIGS. 1, 2, 5, and 5A, the processing procedure of the present invention is: after the material taking device moves downward to take the material to a fixed position (that is, the material taking blocks 827, 810 respectively take the terminal 3 of FIG. 3 onto the first wire shifting clamp 5 and the terminal 3 of FIG. 4B onto the material shifting fixing, block 803 and the front end 811 of the material feeding lever 808 pushes the terminal 3 of FIG. 4C onto the rectifying fixing block 802), the material taking device is moved upward and restored to its home position (that is, the respective material taking blocks 827, 810 are restored to their home positions, while the terminals taken thereby remain at the fixed position). At this time, two portions simultaneously operate. One of the portions is the first wire shifting clamp 5 which moves upward to the fixed position. Thereafter, the wire clipping mold clips the wire and the embossing mold embosses the wire. Then the wire (that is, the pin) is inserted and the cutting mold cuts the wire track (at this time, the terminal positioned on the first wire shifting clamp 5 as shown in FIG. 3 has been processed to form the pattern of the terminal 3 as shown in FIG. 4B). Then the wire clipping mold releases the wire. However, when the first wire shifting clamp 5 moves upward the fixed position, the second wire shifting clamp 6 is moved downward and the cylinder 613 will make the wire shifting block 620 to shift the wire leftward and rightward (at this time, the terminal 3 positioned on the wire shifting fixing block 803 as shown in FIG. 4B is processed to form the pattern of the terminal 3 as shown in FIG. 4C). However, because the rectifying mold 7 is screwed on the second wire shifting clamp 6, when the second wire shifting clamp 6 moves downward, the rectifying mold 7 also moves downward to punch and accurately rectify the terminal of FIG. 4C into the C-shaped pattern. Then the second wire shifting clamp 6 moves upward and the rectifying mold 7 also moves upward the fixed position. Thereafter, the wire shifting block 620 is restored to its home position. In addition, when the wire clipping mold releases the wire, the embossing mold moves upward to the fixed position (at this time, the first wire shifting clamp 5 moves downward to its home position). Then the operation is re-cycled to the operation of the material taking device 8 which moves downward to take the material to the fixed position. Then the operation is sequentially repeatedly performed.

According to the above arrangement, the C-shaped pattern of the terminal can be formed at one time and the processing operation is continuously automatically performed without manually using a tool to bend the terminal.

The above description and drawnings are only used to illustrate one embodiment of the present invention. Any modification or variation derived from the embodiment should fall within the scope of the present invention.

What is claimed is:

1. An SMD-C type terminal automatic pressing machine comprising a support frame, a wire reel rack, a wire clipping mold, an embossing mold, a shearing mold, a material feeding device, a first wire shifting clamp, a second wire shifting clamp and a rectifying mold, the wire reel rack being mounted at an uppermost end of the support frame for inserting with several wire reels, the wire clipping mold, embossing mold and shearing mold being mounted on the support frame for sequentially processing a wire track pulled out from the wire reel mounted on the wire reel rack and performing a pin insertion operation, the automatic pressing machine being characterized in that:

the material feeding device is mounted on one side of a working table of the support frame, having a terminal moving rail including several sections of material feeding rails, material shifting fixing blocks and rectifying fixing blocks, one side of the terminal moving rail being disposed with a vertically movable fixing seat and a material feeding structure connected with each other by a first moving arm for synchronously feeding the material, the vertically movable fixing seat having a roller, whereby when moving downward, the roller is rollable on a plastic guide pad disposed under the vertically movable fixing seat, a second moving arm being mounted on an upper portion of the vertically movable fixing seat, a material taking block being screwed to the first moving arm, the material taking block having a shape of a stepped cylinder, a material feeding lever being disposed at a front end of the second moving arm for pushing a forward terminal in which the wire track is inserted and positioned on the first wire shifting clamp, a restricting hook block being disposed on a lateral side of the terminal moving rail corresponding to the vertically movable fixing seat and at a same position, the restricting hook block being connected with a first spring for restricting the terminal on the terminal moving rail from sliding forward, whereby the material taking block can only move one terminal at one time, another material feeding structure on the lateral side of the terminal moving rail including a third moving arm and a moving arm fixing seat, the material feeding lever being screwed below the front end of the third moving arm, a stepped cylindrical material taking block being disposed on the material feeding lever, when the material taking block moves downward, the material taking block taking a terminal thereunder, when moving forward, the front end of the material feeding lever making the terminal positioned on the material shifting fixing seat move forward, a restricting hook block being disposed on a lateral side of the terminal moving rail corresponding to the material feeding structure and at a same position, the restricting hook block being connected with the first spring for restricting the terminal from automatically sliding onto the material shifting fixing seat;

the first wire shifting clamp being composed of a main body and two wire shifting arms, the two wire shifting arms being fixed on two sides of the main body by a shaft, the wire shifting arms and the main body being formed with corresponding sockets for placing therein a second spring, whereby when the wire shifting arm is pressed, the second spring helps in restoring to a home position, a fixing seat hole being formed on upper side of the main body for the terminal to fixedly insert therein, the main body including a shaft therein for fixedly inserting on the lifting shaft, a recess on one side of the moving arm being disposed with multiple recessed wire channel for placing the wire track of the terminal therein, whereby when the wire shifting arm is pressed, a wire shifting operation can be easily completed, when the wire shifting arms shift the wire, each of the wire shifting arms being synchronously pressed by one thread rod, the one thread rod being driven by a cam to drive a roller screwed on the L-shaped slide block, whereby when the roller rolls on the projecting of the cam, the L-shaped slide block is relatively moved to drive the L-shaped block and pad block screwed on the L-shaped slide block and make the thread rod move forward to press the wire shifting arm, the other thread rod being similarly driven by a cam to drive a roller screwed on the slide block, whereby when the roller rolls on the projection block of the cam, the slide block is directly relatively moved to drive the pushing rod fixing seat and locating block screwed on the slide block and make the thread rod move forward to press the wire shifting arm, the cams of the driving thread rods being positioned on the same transmission shaft so that when the transmission shaft rotates, the two thread rods are directly urged to synchronously press the wire shifting arms via the transmission components;

the second wire shifting clamp being disposed above a tail end of the terminal moving rail, having two symmetrical wire shifting blocks mounted on a wire shifting block fixing seat mounted on a slide rail of a movable retaining board by slide blocks, each wire shifting block fixing seat being driven by a cylinder to move left and right, whereby the wire shifting block thereon also moves left and right to complete the wire shifting operation with respect to the upper half portion of the wire track of the terminal on the material shifting fixing block, an L-shaped block being screwed on the retaining board, a thread rod being screwed under each side of the L-shaped block, a third spring being fitted between the thread rod and the thread rod on the cylinder fixing seat, a rear side of the L-shaped block being screwed to a slide block, whereby the L-shaped block is slidable along the slide rail via the slide block, a locating block being screwed on the L-shaped block, whereby the cylinder can push the locating block to drive the L-shaped block and make the retaining board and wire shifting block ascend and descend;

the rectifying mold being screwed on the rectifying mold fixing seat of the retaining board of the second wire shifting clamp, the surface of lower end of the rectifying mold including multiple recessed lines, whereby when the retaining board moves downward, the rectifying mold synchronously moves downward so as to bend the substantially C-shaped wire track of the terminal into a C-shaped pattern; wherein after the terminal is fed into the material feeding rail, the material taking block of the material feeding device sequentially sends the terminals to a fixed position, after which the wire clipping mold, embossing mold and shearing mold complete the pin insertion operation of the terminals and subsequently the first wire shifting clamp, second wire shifting clamp and rectifying mold operate to bend a straight wire track of the inserted terminal into the C-shaped pattern.

* * * * *